US007763763B2

(12) United States Patent
Font Freide

(10) Patent No.: US 7,763,763 B2
(45) Date of Patent: Jul. 27, 2010

(54) OLEFINS PRODUCTION PROCESS

(75) Inventor: Josephus Johannes Helena Maria Font Freide, Guildford (GB)

(73) Assignee: BP Exploration Operating Company Limited, Middlesex (GB)

( * ) Notice: Subject to any disclaimer, the term of this patent is extended or adjusted under 35 U.S.C. 154(b) by 1147 days.

(21) Appl. No.: 10/494,572

(22) PCT Filed: Nov. 5, 2002

(86) PCT No.: PCT/GB02/05005

§ 371 (c)(1),
(2), (4) Date: May 6, 2004

(87) PCT Pub. No.: WO03/040262

PCT Pub. Date: May 15, 2003

(65) Prior Publication Data

US 2004/0267076 A1 Dec. 30, 2004

(30) Foreign Application Priority Data

Nov. 6, 2001 (GB) ..... 0126643.6

(51) Int. Cl.
*C07C 1/02* (2006.01)
*C07C 27/00* (2006.01)
*C10G 9/36* (2006.01)

(52) U.S. Cl. ..... 585/324; 585/648; 585/652; 208/49; 208/130; 208/950; 518/702; 518/705; 518/715

(58) Field of Classification Search ..... 585/324, 585/652, 348; 208/130, 150, 49; 518/702, 518/705, 715
See application file for complete search history.

(56) References Cited

U.S. PATENT DOCUMENTS 3,923,921 A * 12/1975 Kohfeldt ..... 585/634
5,371,308 A 12/1994 Gosselink et al.
6,066,679 A 5/2000 Leviness et al.
6,103,206 A 8/2000 Taylor, Jr. et al.
6,190,533 B1 2/2001 Bradow et al.

(Continued)

FOREIGN PATENT DOCUMENTS

EP 0 261 870 A1 3/1988

(Continued)

OTHER PUBLICATIONS

Dancuart, Luis; (Sasol Technology); NPRA 2000 Annual Meeting Paper; "Processing of fischer-Tropsch Syncrude and Benefits of Integrating its Products with Conventional Fuels"; 20 pgs; (Mar. 26-28, 2000).

(Continued)

*Primary Examiner*—In Suk Bullock
(74) *Attorney, Agent, or Firm*—Nixon & Vanderhye

(57) ABSTRACT

The present invention provides a process for the production of olefins wherein a synthetic naphtha is passed to a steam cracker. The synthetic naphtha is derived from the fractionation of a Fischer-Tropsch product stream. The Fischer-Tropsch product stream may be separated into a lighter fraction and a heavy fraction and the heavy fraction may be hydrotreated prior to fractionation. Optionally the synthetic naphtha may be hydrogenated to produce a saturated synthetic naphtha which can then be subsequently passed to the steam cracker.

22 Claims, 7 Drawing Sheets

U.S. PATENT DOCUMENTS 6,656,343 B2 * 12/2003 Dancuart ..... 208/58

FOREIGN PATENT DOCUMENTS

| | | | |
|---|---|---|---|
| EP | 0 532 118 | A1 | 3/1993 |
| EP | 0 584 879 | A1 | 3/1994 |
| WO | WO/98/28071 | | 7/1998 |
| WO | WO 00/15587 | | 3/2000 |
| WO | WO 00/58420 | | 10/2000 |
| WO | WO 00/60029 | | 10/2000 |

OTHER PUBLICATIONS

Opposition Correspondence dated May 21, 2008; European Appln. No./Patent No. 02772614.0-2104 / 1442099; Applicant: BP Exploration Operating Company Limited.

Opposition Correspondence dated Oct. 9, 2008; Patent No. 1 442 099; Patent Appln. No. 02772614.0; Patentee: BP Exploration Operating Company Limited; Title: "Olefins Production Process"; Opponent: Sasol Technology (Pty.) Ltd. (19 pgs).

Opposition Correspondence dated Dec. 21, 2007; Patent No. 1 442 099; Patent Appln. No. 02772614.0; Patentee: BP Exploration Operating Company Limited; Title: "Olefins Production Process"; Opponent: Sasol Technology (Pty.) Ltd. (21).

* cited by examiner

OLEFINS PRODUCTION PROCESS

This application is the U.S. National Phase of International Application PCT/GB02/05005, filed 5 Nov. 2002, which designated the U.S.

The present invention relates to synthetic naphtha, processes for the preparation of synthetic naphtha and the use of synthetic naphtha in the production of olefins.

Conventionally olefins are produced by cracking a crude oil derived feedstock. This is usually conducted in the presence of steam in order to minimize the reaction of the produced olefins with one another. Of the oil feedstocks, naphtha is the most commonly employed feedstock and the desired olefins namely ethylene, propylene, butenes and butadiene are produced in useful amounts. However the steam cracking of naphtha derived from crude oil can result in the production of undesirable by-products such as carbon dioxide and aromatics.

It has now been found that a synthetic naphtha derived from the products of the Fischer-Tropsch reaction can be advantageously used in olefin production and can increase the yield of lower olefins (e.g. C2-C4 olefins). Furthermore the use of synthetic naphtha derived from the products of the Fischer-Tropsch reaction in olefin production reduces the amounts of both carbon dioxide and aromatic by-products compared with the use of a crude oil derived naphtha.

Accordingly the present invention provides a process for the production of a synthetic naphtha comprising a) contacting a synthesis gas stream at an elevated temperature and pressure with a Fischer-Tropsch catalyst in a Fischer-Tropsch reactor to generate a hydrocarbon product stream and b) fractionating at least a portion of the hydrocarbon product stream to produce a straight synthetic naphtha.

The hydrocarbon product produced in step (a) may be separated to provide at least one lighter fraction and at least one heavier fraction and at least a portion of the lighter fraction may then be fractionated to produce a straight synthetic naphtha.

Optionally, the hydrocarbon product stream produced in step (a) is separated to provide at least one lighter fraction and at least one heavier fraction. The heavier fraction may then be hydroprocessed to produce an upgraded hydrocarbon product stream which subsequently fractionated to produce an upgraded synthetic naphtha.

Accordingly the present invention also provides a process for the production of a synthetic naphtha comprising a) contacting a synthesis gas stream at an elevated temperature and pressure with a Fischer-Tropsch catalyst in a Fischer-Tropsch reactor to generate a hydrocarbon product stream b) separating the hydrocarbon product stream to provide at least one lighter fraction and at least one heavier fraction c) passing at least a portion of the heavier fraction(s) to a hydroprocessing reactor to produce an upgraded hydrocarbon product stream and d) fractionating at least a portion of the upgraded hydrocarbon product stream to produce an upgraded synthetic naphtha.

In a preferred embodiment of the invention the lighter fraction and the upgraded hydrocarbon product are combined prior to fractionation to produce a combined synthetic naphtha.

Accordingly the present invention further provides a process for the production of a synthetic naphtha comprising a) contacting a synthesis gas stream at an elevated temperature and pressure with a Fischer-Tropsch catalyst in a Fischer-Tropsch reactor to generate a hydrocarbon product stream b) separating the hydrocarbon product stream to provide at least one lighter fraction and at least one heavier fraction c) passing at least a portion of the heavier fraction(s) to a hydroprocessing reactor to produce an upgraded hydrocarbon product stream d) combining the lighter fraction with the upgraded hydrocarbon product stream to produce a combined hydrocarbon stream and e) fractionating at least a portion of the combined hydrocarbon stream to produce a combined synthetic naphtha.

The synthesis gas stream may be produced by passing steam over red-hot coke. Alternatively the synthesis gas stream may be produced from crude oil or from biomass via a gasification process.

In a preferred embodiment the synthesis gas stream is produced by passing a natural gas stream to a reforming zone to produce the synthesis gas stream.

Usually natural gas streams contain sulphur and the sulphur is preferably removed by contacting the natural gas stream comprising sulphur with an adsorbent in an adsorption zone to produce a natural gas stream with reduced sulphur content and an adsorbent with an increased sulphur content.

Sulphur may be present in the natural gas feed as organic sulphur containing compounds e.g. mercaptans or carbonyl sulphide but is usually present in the natural gas stream as hydrogen sulphide. The natural gas stream may also comprise olefins and carbon monoxide. The sulphur is preferably removed by passing the natural gas stream comprising sulphur over an adsorbent at a temperature of between 250-500° C., more preferably between 350-400° C. and at a pressure of 10-100 bar, more preferably between 30-70 bar e.g. 50 bar. The adsorbent may be a copper on graphite adsorbent (e.g. copper on activated carbon) but is preferably a zinc oxide adsorbent wherein the zinc oxide is contacted with hydrogen sulphide and converted to zinc sulphide.

If the sulphur content of the natural gas stream is above 30 ppm, preferably above 50 ppm the gas stream may be contacted with an amine prior to being passed to the adsorption zone.

Advantageously if the natural gas stream comprising sulphur also comprises organic sulphur containing compounds the gas stream may be contacted with a mercaptan conversion catalyst prior to contacting the adsorbent. The mercaptan conversion catalyst converts the organic sulphur containing compounds e.g. mercaptans to hydrogen sulphide. The gas stream is usually contacted with the mercaptan conversion catalyst at a temperature of between 250-500° C., more preferably between 350-400° C. and at a pressure of 10-100 bar, more preferably between 30-70 bar e.g. 50 bar.

The mercaptan conversion catalyst is usually a supported metal catalyst and comprises at least one metal selected from the group consisting of platinum, palladium, iron, cobalt, nickel, molybdenum, and tungsten a support material. Preferably the mercaptan conversion catalyst comprises at least two metals selected from the above group and most preferably the mercaptan conversion catalyst comprises molybdenum and cobalt.

The support may be a solid oxide having surface OH groups. The support may be a solid metal oxide especially an oxide of a di, tri or tetravalent metal. The metal of the oxide may be a transition metal, a non transition metal or a rare earth metal. Examples of solid metal oxides include alumina, titania, cobaltic oxide, zirconia, ceria, molybdenum oxide, magnesia and tungsten oxide. The support may also be a solid non metal oxide such as silica. The support may also be a mixed oxide such as silica-alumina, magnesia-alumina, alumina-titania or a crystalline aluminosilicate. Preferably the support is alumina.

The total weight of metal in the mercaptan conversion catalyst may be 0.2-20% by weight (as metal) based on the weight of support. The mercaptan conversion catalyst preferably comprises at least 1% e.g. 1-30% such as 10-20% e.g. 12% of molybdenum (based on the weight of support) and at least 0.1% of cobalt e.g. 0.1-20% such as 3-10% e.g. 4% of cobalt (based on the weight of support) is usually present.

Alternatively if the natural gas stream comprising sulphur and organic sulphur containing compounds also contains olefins and/or carbon monoxide the gas stream may be contacted with an olefin conversion catalyst prior to contacting the adsorbent.

The olefin conversion catalyst is used to remove olefins and/or carbon monoxide from the natural gas stream wherein the olefins are converted to methane and the carbon monoxide is converted to carbon dioxide. The gas stream may be contacted with the olefin conversion catalyst at a temperature of between 400-1100° C., more preferably between 500-700° C. and at a pressure of 10-100 bar, more preferably between 30-70 bar e.g. 50 bar.

The olefin conversion catalyst is also a supported metal catalyst as described above but preferably comprises at least 1% e.g. 1-50% such as 10-30% e.g. 25% of nickel (based on the weight of support) and the support is preferably alumina.

The synthesis gas may be prepared in the reforming zone using any of the processes known in the art. The reforming zone may be substantially free of reforming catalyst as in a partial oxidation reaction where an oxygen containing gas is used to partially combust the natural gas to provide a synthesis gas stream comprising natural gas.

Alternatively the reforming zone comprises a reforming catalyst as in steam reforming or autothermal reforming. The reaction of natural gas with steam is known as steam reforming, while the reaction of natural gas with steam in the additional presence of oxygen or air or any combination thereof is known as autothermal reforming. Either steam reforming or autothermal reforming, or a combination of both, may be used.

Specific combinations of steam reforming and autothermal reforming are known. In series reforming, the product from a steam reformer is passed to an autothermal reformer along with fresh natural gas and oxygen containing feed. In convective reforming, steam and natural gas are partially reacted in a steam reformer, and the product is passed to an autothermal reformer along with fresh natural gas, steam and oxygen containing feed. The product stream from the autothermal reformer, which is at a very high temperature, is circulated back to the steam reformer. Suitably, the product stream from the autothermal reformer is passed through a heat exchanger prior to being recycled to the reaction zone of the steam reformer so as to provide a source of heat for the steam reforming reaction. The heat exchanger is preferably a 'shell and tube heat exchanger'. Any of these arrangements may be used in the process of the present invention.

The temperature of the reforming zone is preferably in the range of from 700 to 1100° C., especially 780 to 1050° C. The pressure of the reforming zone is preferably in the range of from 10 to 80 bar, especially 20 to 40 bar. Any suitable reforming catalyst, for example a nickel catalyst, may be used.

Preferably, the reforming zone is a "Compact Reformer" as described in "Hydrocarbon Engineering", 2000, 5, (5), 67-69; "Hydrocarbon Processing", 79/9, 34 (September 2000); "Today's Refinery", 15/8, 9 (August 2000); WO 99/02254; and WO 200023689.

Usually the ratio of hydrogen to carbon monoxide in the synthesis gas produced in the reforming zone and used in the Fischer-Tropsch synthesis step of the process of the present invention is in the range of from 20:1 to 0.1:1, especially 5:1 to 1:1 by volume, typically 2:1 by volume. The synthesis gas may contain additional components such as nitrogen, water, carbon dioxide and lower hydrocarbons such as unconverted methane.

The Fischer-Tropsch catalyst which may be employed in the process of the present invention is any catalyst known to be active in Fischer-Tropsch synthesis. For example, Group VIII metals whether supported or unsupported are known Fischer-Tropsch catalysts. Of these iron, cobalt and ruthenium are preferred, particularly iron and cobalt, most particularly cobalt.

A preferred catalyst is supported on an inorganic oxide, preferably a refractory inorganic oxide. Preferred supports include silica, alumina, silica-alumina, the Group IVB oxides, titania (primarily in the rutile form) and most preferably zinc oxide. The support generally has a surface area of less than about 100 $m^2/g$ but may have a surface area of less than 50 $m^2/g$ or less than 25 $m^2/g$, for example, about 5 $m^2/g$.

Alternatively the support may comprise carbon.

The catalytic metal is present in catalytically active amounts usually about 1-100 wt %, the upper limit being attained in the case of unsupported metal catalysts, preferably 2-40 wt %. Promoters may be added to the catalyst and are well known in the Fischer-Tropsch catalyst art. Promoters can include ruthenium, platinum or palladium (when not the primary catalyst metal), aluminium, rhenium, hafnium, cerium, lanthanum and zirconium, and are usually present in amounts less than the primary catalytic metal (except for ruthenium which may be present in coequal amounts), but the promoter: metal ratio should be at least 1:10. Preferred promoters are rhenium and hafnium.

The catalyst may have a particle size in the range 5 to 3000 microns, preferably 5 to 1700 microns, most preferably 5 to 500 microns, and advantageously 5 to 100 microns, for example, in the range 5 to 30 microns.

The Fischer-Tropsch reaction is preferably carried out at a temperature of 180-360° C., more preferably 190-240° C. and at a pressure of 5-50 bar, more preferably 15-35 bar, generally 20-30 bar.

The synthesis gas may be contacted with the Fischer-Tropsch catalyst in any type of reactor for example in a fixed or fluidized bed reactor but, preferably, is contacted with the Fischer-Tropsch catalyst in a slurry reactor e.g. a slurry bubble column in which a Fischer-Tropsch catalyst is primarily distributed and suspended in the slurry by the energy imparted from the synthesis gas rising from the gas distribution means at the bottom of the slurry bubble column as described in, for example, U.S. Pat. No. 5,252,613.

The synthesis gas may also be contacted with a suspension of a particulate Fischer-Tropsch catalyst in a liquid medium in a system comprising at least one high shear mixing zone and a reactor vessel. This Fischer-Tropsch process is described in PCT patent application number WO0138269 which is herein incorporated by reference.

The hydrocarbon product stream generated in the Fischer-Tropsch reactor has a broad molecular weight distribution comprising predominantly straight chain, saturated hydrocarbons which typically have a chain length of between 1 to 30 carbon atoms. Preferably hydrocarbons with between 1 to 4 carbon atoms are recycled back to the reforming zone and/or to the Fischer-Tropsch reactor.

The hydrocarbon product stream may be separated into at least one lighter fraction usually comprising hydrocarbons with between 5 to 14 carbon atoms and at least one heavier fraction usually comprising hydrocarbons with between 15 to 30 carbon atoms. Suitably this separation is achieved by flash distillation wherein the hydrocarbon product stream is passed to a vessel and the temperature of the stream is raised and/or the pressure of the stream is lowered such that a gaseous lighter fraction may be separated from a non-gaseous heavier fraction.

The straight synthetic naphtha produced from fractionation of the hydrocarbon product stream or from fractionation of the lighter fraction comprises hydrocarbons with between 5 to 11 carbon atoms and usually comprises a high proportion of normal paraffins. The iso-paraffin:normal paraffin ratio is advantageously less is than 0.5, preferably less than 0.05 and especially between 0.01 and 0.04 e.g. 0.035. The straight synthetic naphtha also comprises a high proportion of olefins usually up to 10% by weight, and preferably up to 5% by weight e.g. 2% by weight.

The heavier fraction may be cracked and/or isomerised in the hydroprocessing reactor to provide an upgraded hydrocarbon product stream.

The hydroprocessing reactor usually contains a hydrocracking and/or isomerisation catalyst.

The hydrocracking catalyst usually comprises a metal selected from the group consisting of platinum, palladium, cobalt, molybdenum, nickel and tungsten supported on a support material such as alumina, silica-alumina or a zeolite. Preferably, the catalyst comprises either cobalt/molybdenum or platinum supported on alumina or platinum or palladium supported on a zeolite. The most suitable hydrocracking catalysts include catalysts supplied by Akzo Nobel, Criterion, Chevron, or UOP.

The isomerisation catalyst usually acidic in nature e.g. alumina, silica-alumina or a zeolite. Advantageously the isomerisation catalyst is a Friedel-Crafts acid which comprises a metal halide, especially a chloride or a bromide, of transition metals of Groups IIIA to IIB of the Periodic Table (in F. A. Cotton & G. Wilkinson Advanced Inorganic Chemistry Publ. Interscience 1966) and elements of Groups IIIB-VB. Thus examples are chlorides of iron, zinc, titanium and zirconium, and chlorides and fluorides of boron, aluminium, antimony and arsenic. Preferred catalysts are boron trifluoride, ferric chloride and niobium and tantalum and antimony pentafluoride.

The hydrocracking catalysts may also be capable of acting as isomerisation catalysts in particular those wherein the metals are supported on alumina, silica-alumina or a zeolite, whilst the isomerisation catalyst may also exhibit some hydrocracking activity.

The isomerisation and/or hydrocracking catalyst generally has a surface area of less than about 450 $m^2/g$, preferably less than 350 $m^2/g$, more preferably less than 300' $m^2/g$, for example, about 200 $m^2/g$.

The hydroprocessing reaction is preferably carried out at a temperature of 200-500° C., more preferably 300-400° C. and at a pressure of 5-50 bar, more preferably 15-35 bar, generally 20-30 bar.

The upgraded hydrocarbon product stream comprises hydrocarbons of shorter chain length and/or increased degree of branching than that of the heavier fraction. Usually the upgraded hydrocarbon product stream will contain iso-paraffins and normal paraffins and usually the iso-paraffin to normal paraffin ratio of the upgraded hydrocarbon product stream will increase compared with the heavier fraction.

The upgraded synthetic naphtha produced from fractionation of the upgraded product stream usually comprises hydrocarbons with between 5 to 11 carbon atoms and usually has an iso-paraffin:normal paraffin ratio of between 0.5 to 5 and preferably between 1 to 3 e.g. 2.

Advantageously both the straight synthetic naphtha and the upgraded synthetic naphtha comprise less than 5% by weight of naphthenes e.g. 1-3%.

The combined synthetic naphtha produced by combining the lighter fraction with the upgraded hydrocarbon product stream prior to fractionation usually comprises hydrocarbons with between 5 to 11 carbon atoms.

The fractionation is usually carried out continuously in a distillation tower. The hydrocarbon product stream, the lighter fraction, the upgraded hydrocarbon product stream or the combined hydrocarbon stream is usually heated to between 250 to 500° C., preferably between 300 to 400° C. e.g. 350° C. and pumped into the tower wherein the feed stream is fractionated.

The processes described above provide straight, upgraded and combined synthetic naphthas having a boiling point range of between 5-250° C., preferably between 10-200° C. and advantageously between 15-150° C. and a sulphur content of less than 1 ppm preferably less than 0.5 ppm e.g. less than 0.1 ppm. Usually the synthetic naphtha has a nitrogen content of less than 1 ppm, preferably less than 0.5 ppm e.g. less than 0.1 ppm.

The invention provides also a process for the production of a saturated synthetic naphtha wherein said process comprises passing at least a portion of at least one of the synthetic naphtha streams selected from the straight synthetic naphtha stream, the upgraded synthetic naphtha stream, and the combined synthetic naphtha stream to a hydrogenation reactor to produce a saturated synthetic naphtha comprising hydrocarbons with between 5 to 11 carbon atoms, an iso-paraffin: normal paraffin ratio of less than 0.5, preferably less than 0.05 and an olefin content of less than 2% by weight.

The saturated synthetic naphtha usually has a boiling point range of between 5-250° C., preferably between 10-200° C. and advantageously between 15-150° C. and a sulphur content of less than 1 ppm preferably less than 0.5 ppm e.g. less than 0.1 ppm.

Usually the saturated synthetic naphtha has a nitrogen content of less than 1 ppm, preferably less than 0.5 ppm e.g. less than 0.1 ppm.

The present invention further provides a process for the production of olefins wherein a synthetic naphtha as may be used as a feedstock in a process for the production of olefins wherein the synthetic naphtha is passed to a steam cracker wherein at least a portion of the synthetic naphtha is converted to olefins.

Preferably the synthetic naphtha is produced by at least one of the processes herein described above.

The synthetic naphtha may be passed to an hydrogenation reactor to produce a saturated synthetic naphtha. The saturated synthetic naphtha may then be passed to the steam cracker and it has been found that the use of the saturated synthetic naphtha in the process for the production of olefins reduces the propensity towards coking. Usually the coking index of the saturated synthetic naphtha is reduced by 30, preferably 50, and advantageously 80 when compared to the coking index of straight synthetic naphtha.

The steam cracker usually operates in the absence of a catalyst at a temperature between 700-900° C. preferably 750-850° C. e.g. 800° C. wherein steam and the synthetic naphtha are fed into the reactor. Preferably no catalyst is employed within the steam cracker. The steam:naphtha weight ratio is usually in the range of 20:80 to 80:20, preferably in the range of 30:70 to 70:30 e.g. 40:60.

BRIEF DESCRIPTION OF THE DRAWINGS

The invention will now be illustrated with reference to the accompanying drawings, in which:

In FIG. 1 synthesis gas, formed by passing natural gas through an adsorption zone and then subsequently into a reforming zone (not shown), is passed via line (1) to a Fischer-Tropsch reactor (2) wherein it is converted to a hydrocarbon product stream which is passed via line (3) to a fractional distillation column (4) comprising a reboiler (5). A straight synthetic naphtha stream exits the fractional distillation column (4) via line (6) and passes into a steam cracker (7) wherein the straight synthetic naphtha stream is converted to olefins that exit the steam cracker (7) via line (8).

In FIG. 2 synthesis gas, formed by passing natural gas through an adsorption zone and then subsequently into a reforming zone (not shown), is passed via line (1) to the Fischer-Tropsch reactor (2) wherein it is converted to a hydrocarbon product stream which is passed via line (3) to a separator (9). The hydrocarbon product stream is separated into a lighter fraction which exits the separator (9) via line (10) and passes into the fractional distillation column (4) comprising a reboiler (5). A heavier fraction exits the separator (9) via line (11). A straight synthetic naphtha stream exits the fractional distillation column (4) via line (6) and passes into the steam cracker (7) wherein the straight synthetic naphtha stream is converted to olefins that exit the steam cracker (7) via line (8).

In FIG. 3 synthesis gas, formed by passing natural gas through an adsorption zone and then subsequently into a reforming zone (not shown), is passed via line (1) to the Fischer-Tropsch reactor (2) wherein it is converted to a hydrocarbon product stream which is passed via line (3) to the separator (9). The hydrocarbon product stream is separated into a lighter fraction which exits the separator (9) via line (10) and passes into the fractional distillation column (4) comprising a reboiler (5). A heavier fraction exits the separator (9) via line (11). A straight synthetic naphtha stream exits the fractional distillation column (4) via line (6) and passes into a hydrogenation reactor (12) wherein it is saturated to produce a saturated synthetic naphtha which passes via line (13) into the steam cracker (7) wherein the saturated straight synthetic naphtha stream is converted to olefins that exit the steam cracker (7) via line (8).

In FIG. 4 synthesis gas, formed by passing natural gas through an adsorption zone and then subsequently into a reforming zone (not shown), is passed via line (1) to the Fischer-Tropsch reactor (2) wherein it is converted to a hydrocarbon product stream which is passed via line (3) to the separator (9). The hydrocarbon product stream is separated into a lighter fraction which exits the separator (9) via line (10) and a heavier fraction which exits the separator (9) via line (11) and passes into a hydroprocessing reactor (14) wherein the heavier fraction is converted to an upgraded hydrocarbon product stream. The upgraded hydrocarbon product stream passes into the fractional distillation column (4) comprising a reboiler (5) via line (15) and an upgraded synthetic naphtha stream exits the distillation column (4) and passes into the steam cracker (7) via line (6) wherein it is converted to olefins that exit the steam cracker (7) via line (8).

In FIG. 5 synthesis, formed by passing natural gas through an adsorption zone and then subsequently into a reforming zone (not shown), gas is passed via line (1) to the Fischer-Tropsch reactor (2) wherein it is converted to a hydrocarbon product stream which is passed via line (3) to the separator (9). The hydrocarbon product stream is separated into a lighter fraction which exits the separator (9) via line (10) and a heavier fraction which exits the separator (9) via line (11) and passes into a hydroprocessing reactor (14) wherein the heavier fraction is converted to an upgraded hydrocarbon product stream which exits the hydroprocessing reactor (14) via line (15). The lighter fraction is combined with the upgraded hydrocarbon product stream and the combined hydrocarbon product stream is passed into the fractional distillation column (4) comprising a reboiler (5) via line (16) and a combined synthetic naphtha stream exits the distillation column (4) and passes into the steam cracker (7) via line (6) wherein it is converted to olefins that exit the steam cracker (7) via line (8).

The invention will now be illustrated in the following example.

The following naphtha cuts were investigated: crude naphtha (not according to the invention), straight synthetic naphtha (produced from the fractionation of the hydrocarbon product stream) and upgraded synthetic naphtha. The naphtha compositions are shown in table 1.

| | Crude Naphtha (not according to the invention) | | | | | | |
|---|---|---|---|---|---|---|---|
| | Weight % | | | | | | |
| | saturates | | | unsaturates | | | |
| Carbon number | iso-paraffins | normal paraffins | napthenes | iso-olefins | normal olefins | napthenes | aromatics |
| 3 | | | | | | | |
| 4 | | | | | | | |
| 5 | 5.76 | 8.83 | 0.83 | | | | |
| 6 | 7.83 | 8.22 | 7.04 | | | | 0.66 |
| 7 | 6.12 | 6.82 | 8.71 | | | | 2.20 |
| 8 | 5.76 | 5.25 | 5.32 | | | | 4.06 |

-continued

| Crude Naphtha (not according to the invention) | | | | | | | |
|---|---|---|---|---|---|---|---|
| | Weight % | | | | | | |
| | saturates | | | unsaturates | | | |
| Carbon number | iso-paraffins | normal paraffins | napthenes | iso-olefins | normal olefins | napthenes | aromatics |
| 9 | 4.93 | 3.06 | 4.10 | | | | |
| 10 | 1.80 | 0.44 | 1.33 | | | | |
| 11 | | 0.12 | | | | | |

iso-paraffin:normal paraffin ratio 0.98

| Straight Synthetic Naphtha | | | | | | | |
|---|---|---|---|---|---|---|---|
| | Weight % | | | | | | |
| | saturates | | | unsaturates | | | |
| Carbon number | iso-paraffins | normal paraffins | napthenes | iso-olefins | normal olefins | napthenes | aromatics |
| 3 | | | | | | | |
| 4 | | | | | | | |
| 5 | | 0.03 | | | | | |
| 6 | 0.04 | 1.82 | — | 0.52 | 0.2 | | |
| 7 | 0.30 | 9.24 | | 1.30 | 0.89 | | |
| 8 | 0.54 | 17.0 | | 2.32 | 1.02 | | |
| 9 | 0.91 | 29.3 | | 1.33 | 0.95 | | |
| 10 | 1.16 | 25.9 | | | 0.85 | | |
| 11 | | 3.01 | | | 0.68 | | |

iso-paraffin:normal paraffin ratio 0.035

| Upgraded Synthetic Naphtha | | | | | | | |
|---|---|---|---|---|---|---|---|
| | Weight % | | | | | | |
| | saturates | | | unsaturates | | | |
| Carbon number | iso-paraffins | normal paraffins | napthenes | iso-olefins | normal olefins | napthenes | aromatics |
| 3 | | 0.1 | | | | | |
| 4 | 0.05 | | | | | | |
| 5 | 8.32 | 6.30 | 0.02 | | | | |
| 6 | 11.51 | 7.59 | 0.34 | 0.02 | | 0.02 | |
| 7 | 14.52 | 7.69 | 0.81 | | | 0.02 | |
| 8 | 16.32 | 6.38 | 1.07 | | | 0.04 | |
| 9 | 12.51 | 2.77 | 0.61 | | | 0.06 | |
| 10 | 1.88 | 0.28 | | | | | |
| 11 | | | | | | | |

iso-paraffin:normal paraffin ratio 2.09

Figure 1:
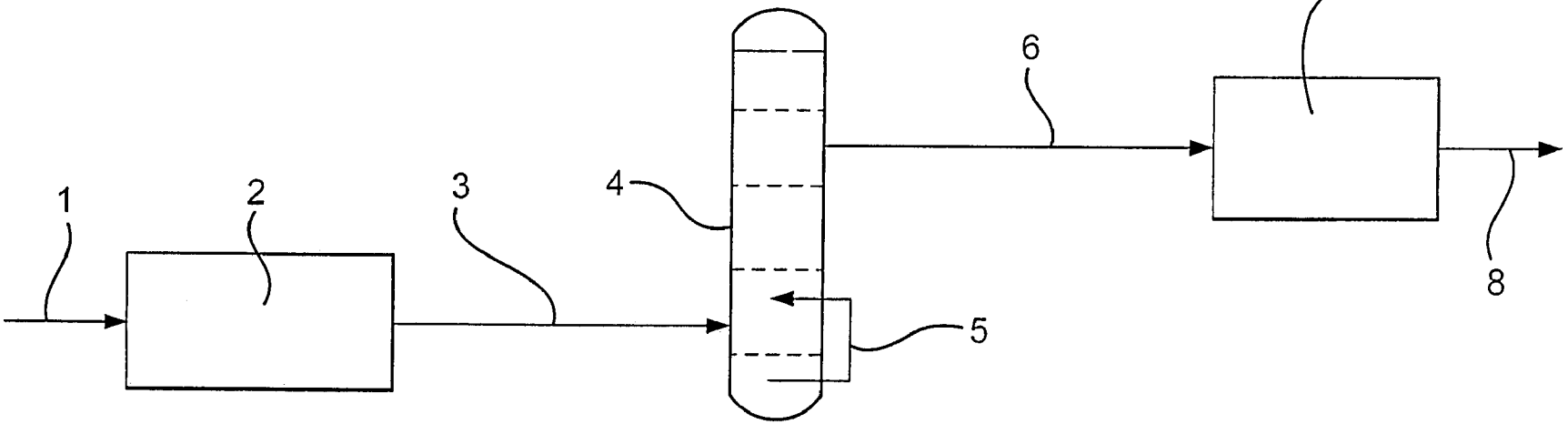
FIGS. 1 to 5 which show five process schemes whereby synthesis gas is converted to hydrocarbon products and where the products so produced are further treated to produce a synthetic naphtha which in a final stage can be steam cracked to produce olefins.
Figure 2:
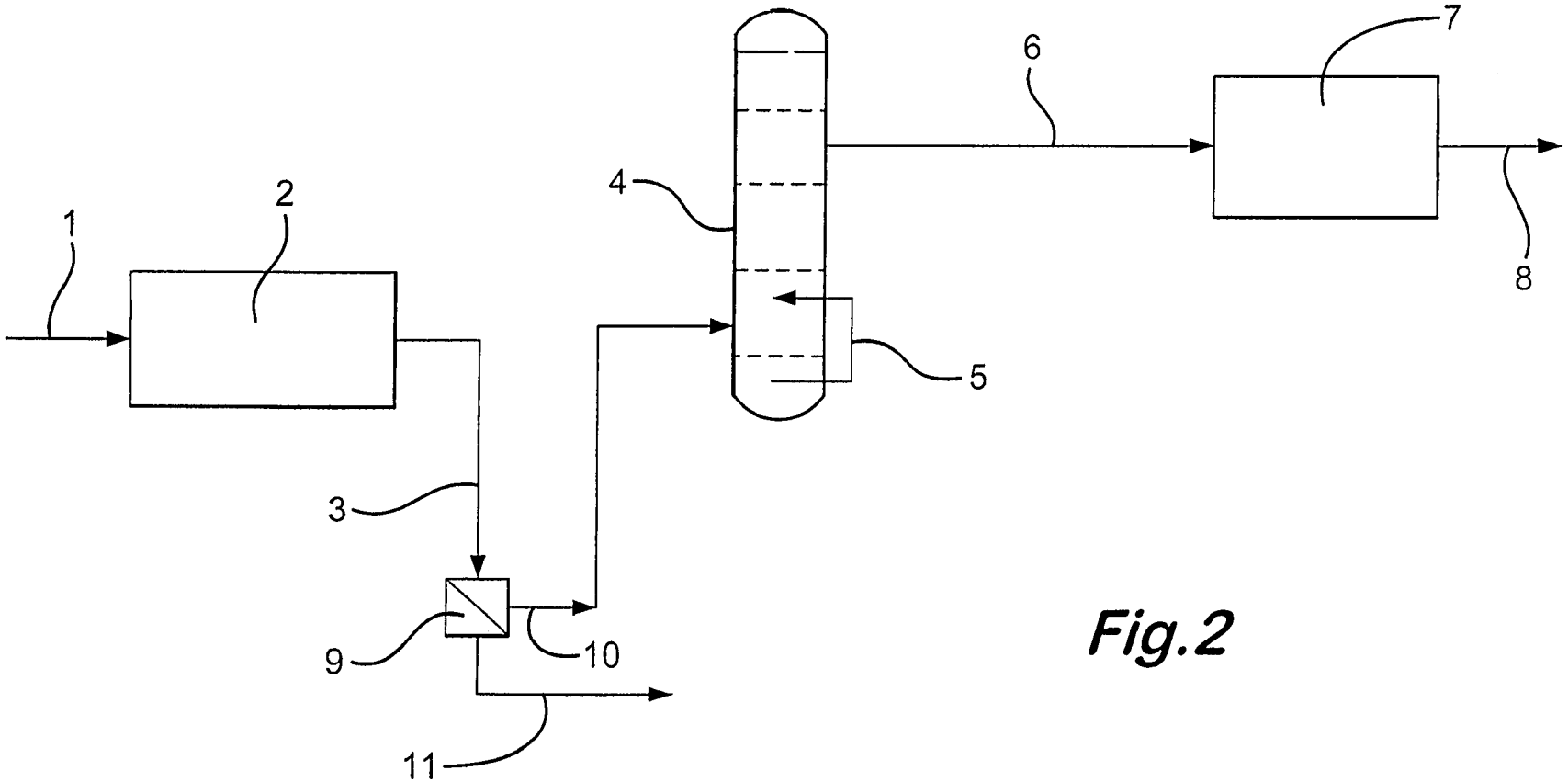
Figure 3:
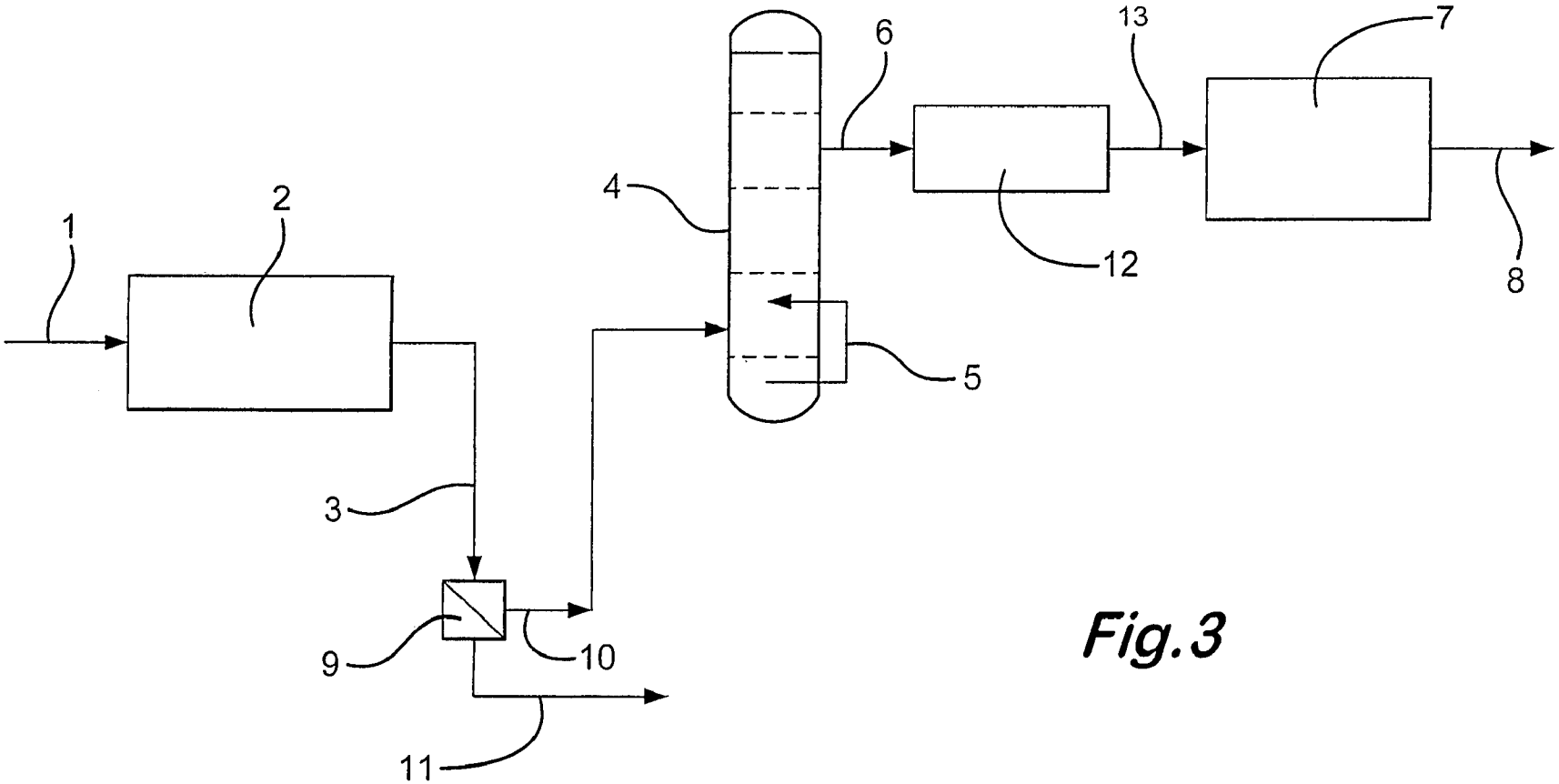
Figure 4:
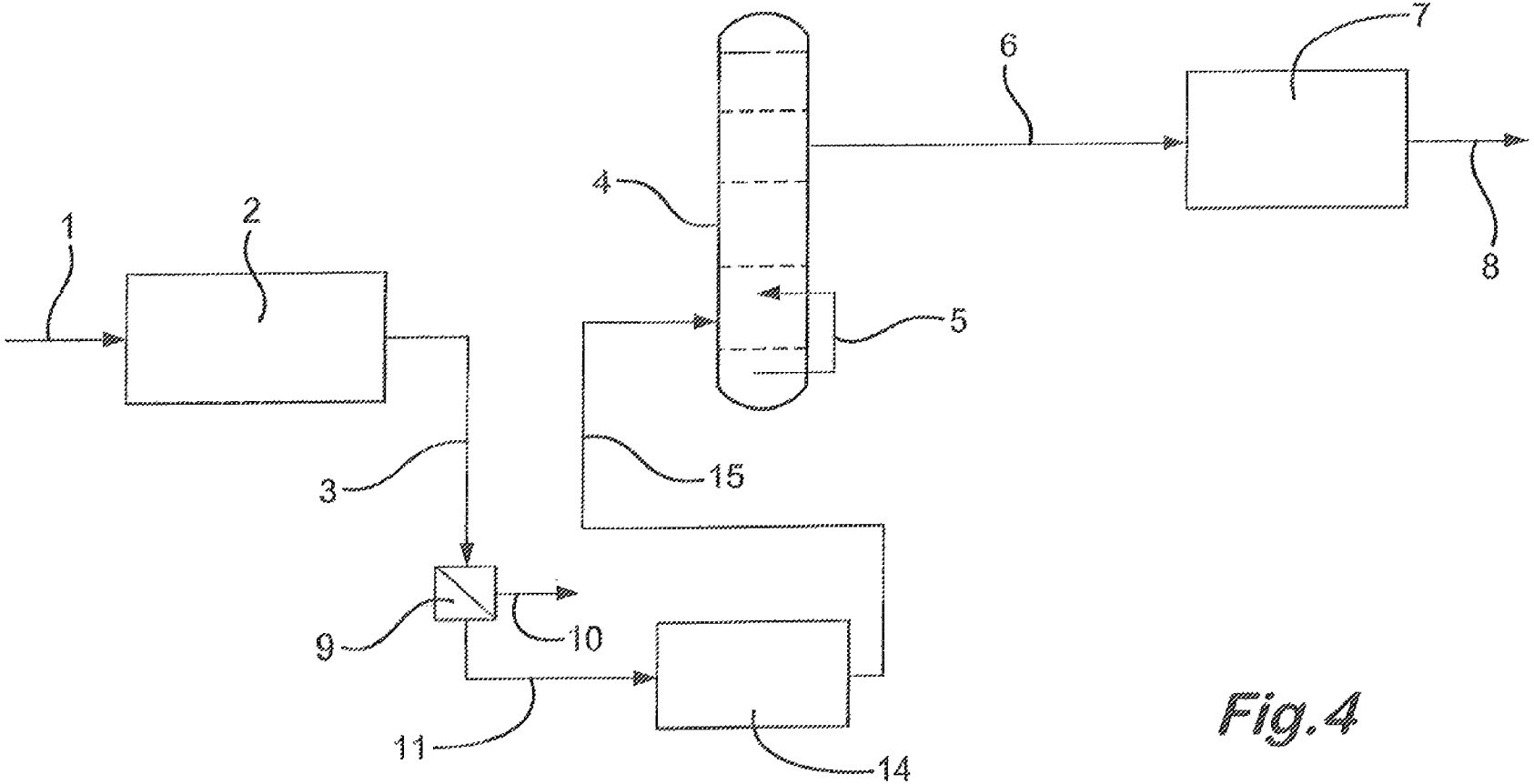
Figure 5:
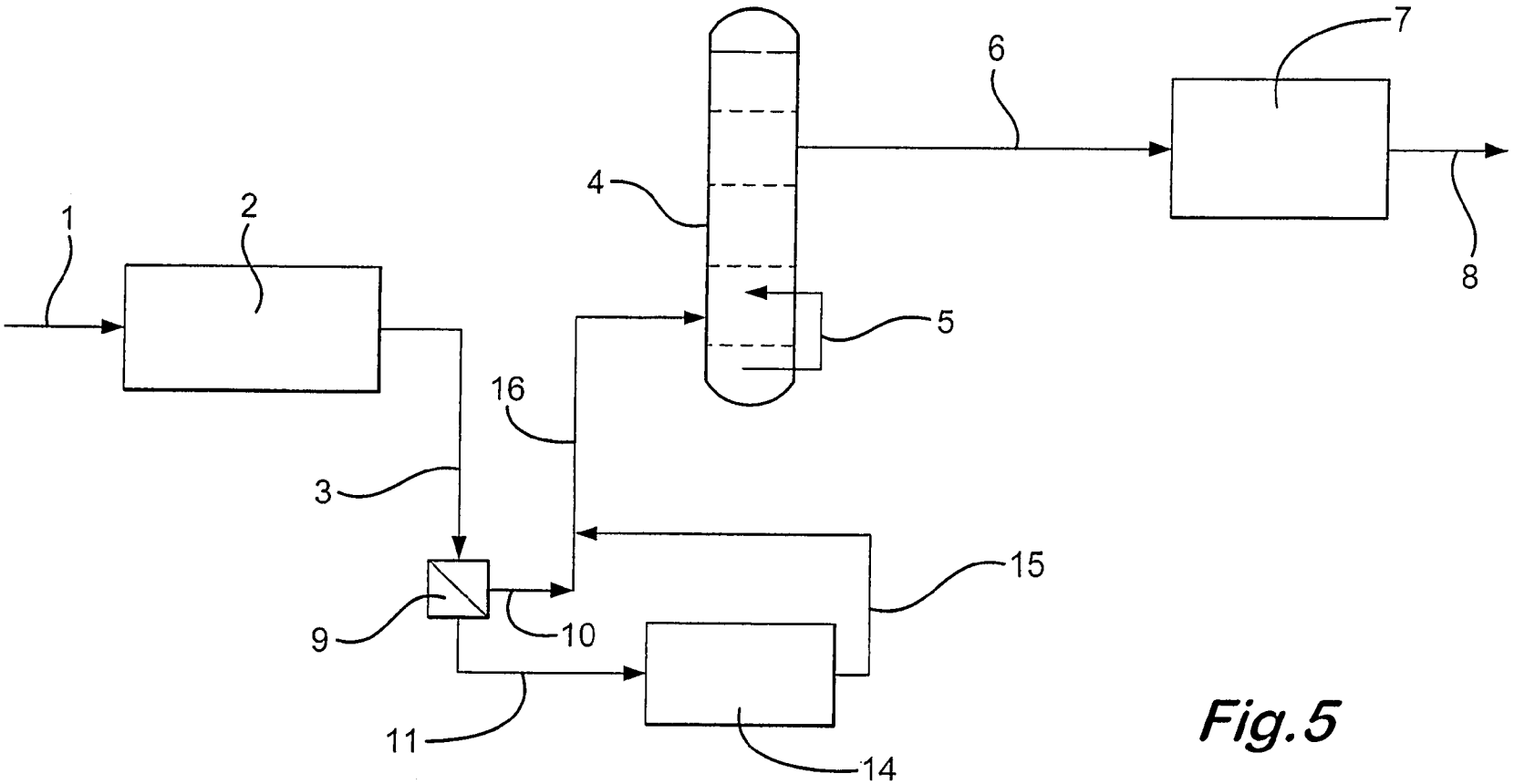
Figure 6:
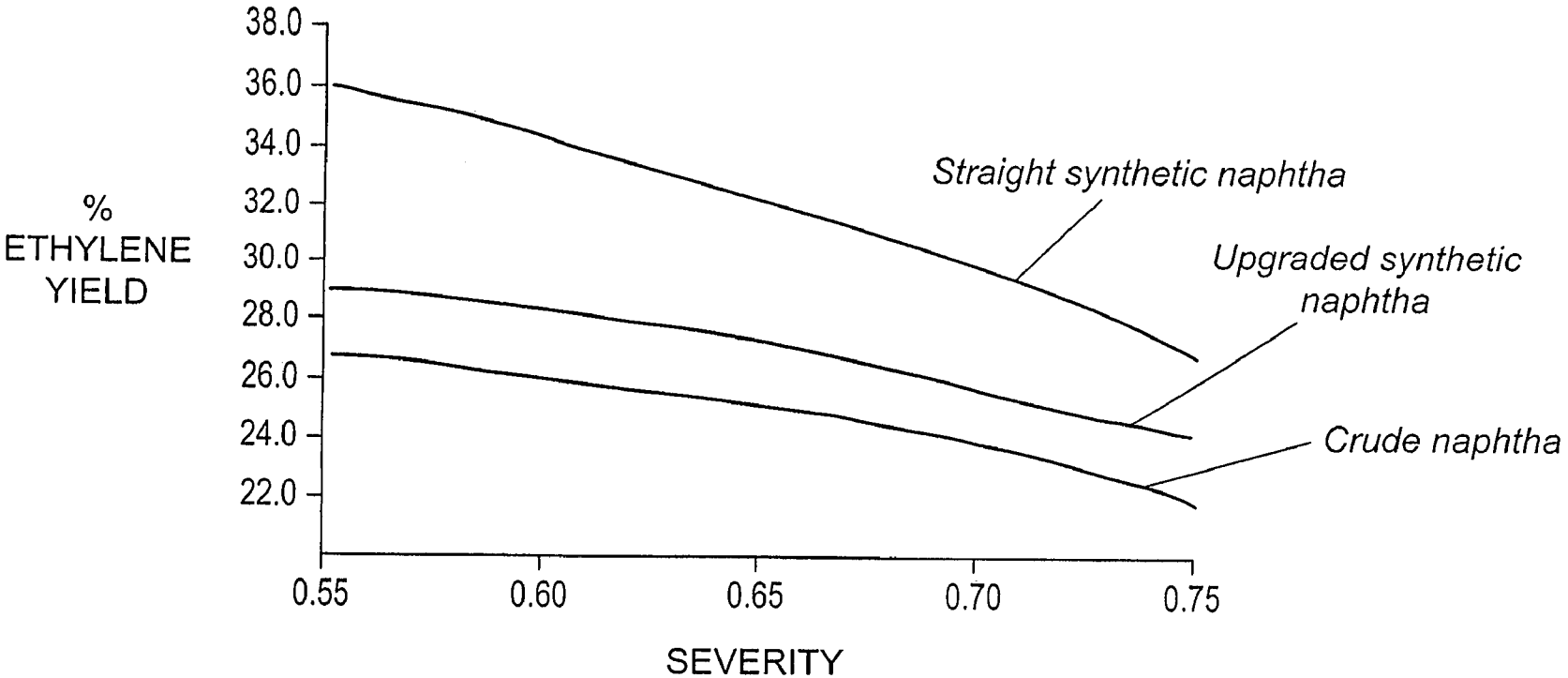
FIG. 6 are plots of %Ethylene feed versus Severity.
Figure 7:
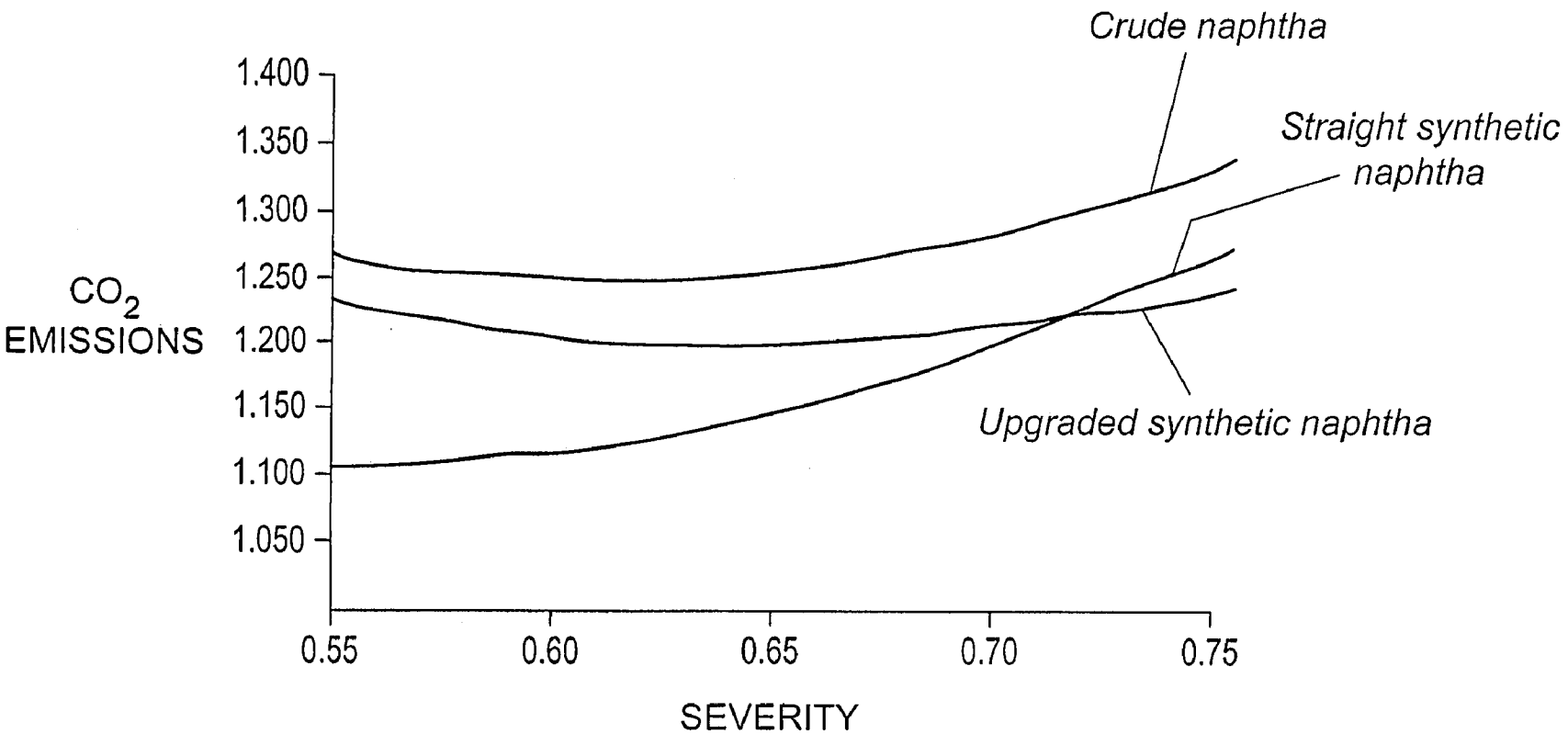
FIG. 7 are plots of Carbon Dioxide Emissions versus Severity.

The above compositions were passed into a steam cracker at a pressure 1.65 bar; with a fuel heating rate of 5.5 t/h, wherein the fuel produced 11,500 thermies per tonne and the % ethylene yield was measured against increasing severity. The results are shown in table 1 and FIG. 6. The $CO_2$ emissions were also measured and expressed as tonne of $CO_2$ per tonne of ethylene produced and the results are shown in table 2 and FIG. 7. It can be seen that use of synthetic F-T naphtha reduces $CO_2$ emissions and increases the % ethylene yield.

TABLE 1

| | % Ethylene Yield | | |
|---|---|---|---|
| Severity | Crude Naphtha | Straight Synthetic Naphtha | Upgraded Synthetic Naphtha |
| 0.55 | 27.0 | 36.0 | 29.0 |
| 0.60 | 26.0 | 34.0 | 28.0 |
| 0.65 | 25.0 | 32.0 | 27.0 |
| 0.70 | 23.2 | 28.5 | 26.0 |
| 0.75 | 22.0 | 27.0 | 24.0 |

TABLE 2

| | $CO_2$ Emissions | | |
|---|---|---|---|
| Severity | Crude Naphtha | Straight Synthetic Naphtha | Upgraded Synthetic Naphtha |
| 0.55 | 1.275 | 1.120 | 1.240 |
| 0.60 | 1.260 | 1.125 | 1.210 |
| 0.65 | 1.275 | 1.150 | 1.210 |
| 0.70 | 1.290 | 1.200 | 1.230 |
| 0.75 | 1.340 | 1.275 | 1.250 |

The invention claimed is:

1. A process for the production of olefins comprising passing a synthetic naphtha to a steam cracker wherein at least a portion of the synthetic naphtha is a combined synthetic naphtha produced from a process comprising:

a) contacting a synthesis gas stream at an elevated temperature and pressure with a Fischer-Tropsch catalyst in a Fischer-Tropsch reactor to generate a hydrocarbon product stream;

b) separating the hydrocarbon product stream to provide at least one lighter fraction and at least one heavier fraction;

c) passing at least a portion of the heavier fraction to a hydroprocessing reactor to produce an upgraded hydrocarbon product stream;

d) combining the upgraded hydrocarbon product stream with the lighter fraction; and e) fractionating the combined lighter fraction and upgraded hydrocarbon product stream in a fractionator to produce a combined synthetic naphtha stream, said lighter fraction not being subjected to any intermediate hydroprocessinq prior to being combined with the upgraded hydrocarbon product stream; and f) passing the combined synthetic naphtha stream to a steam cracker to produce olefins.

2. A process according to claim 1 wherein the lighter fraction comprises hydrocarbons with between 5 to 14 carbon atoms and the heavier fraction comprises hydrocarbons with between 15 to 30 carbon atoms.

3. A process according to claim 1 wherein the hydroprocessing reactor contains a hydrocracking and/or isomerisation catalyst.

4. A process according to claim 1 wherein the hydroprocessing reaction is carried out at a temperature of between 200-500° C.

5. A process according to claim 1 wherein the hydroprocessing reaction is carried out at a pressure of between 5-50 bar.

6. A process according to claim 1 wherein the hydrocarbon product stream generated in the Fischer-Tropsch reactor has a broad molecular weight distribution comprising predominantly straight chain, saturated hydrocarbons which have a chain length of between 1 to 30 carbon atoms.

7. A process according to claim 1 wherein the fractionation is carried out continuously in a distillation tower and wherein the combined hydrocarbon stream is heated to between 250 to 500° C. before entering into said distillation tower.

8. A process according to claim 1 wherein the synthesis gas stream is produced by contacting a natural gas stream comprising sulphur with an adsorbent in an adsorption zone to produce a natural gas stream with reduced sulphur content and an adsorbent with increased sulphur content and reacting said natural gas stream with reduced sulphur content in at least one reforming zone to produce the synthesis gas stream.

9. A process according to claim 8 wherein the natural gas stream comprising sulphur over is passed over the adsorbent at a temperature of between 250-500° C.

10. A process according to claim 8 wherein the natural gas stream comprising sulphur is passed over the adsorbent at a pressure of 10100bar.

11. A process according to claim 8 wherein the adsorbent is a zinc oxide adsorbent.

12. A process according to claim 8 wherein the synthetic naphtha produced has a boiling point range of between 5-250° C. and a sulphur content of less than 1 ppm and a nitrogen content of less than 1 ppm.

13. A process according to claim 8 wherein the reforming reaction is carried out at a temperature in the range of from 700 to 1100° C.

14. A process according to claim 8 wherein the reforming reaction is carried out at a pressure in the range of from 10 to 80 bar.

15. A process according to claim 1 wherein the ratio of hydrogen to carbon monoxide in the synthesis gas in the range of from 20:1 to 0.1:1.

16. A process according to claim 1 wherein the Fischer-Tropsch catalyst comprises cobalt on zinc oxide.

17. A process according to claim 1 wherein the Fischer-Tropsch reaction carried out at a temperature of 180-360° C.

18. A process according to claim 1 wherein the Fischer-Tropsch reaction carried out at a pressure of 5-50 bar.

19. A process according to claim 1 wherein the synthesis gas is contacted with a suspension of a particulate Fischer-Tropsch catalyst in a liquid medium in a system comprising at least one high shear mixing zone and a reactor vessel.

20. A process according to claim 1 wherein the steam cracker operates in the absence of a catalyst.

21. A process according to claim 1 wherein the steam cracker operates at a temperature of between 700-900° C.

22. A process according to claim 1 wherein the steam: synthetic naphtha weight ratio in the steam cracker is in the range of 20:80 to 80:20.

* * * * *